United States Patent [19]

Austin

[11] Patent Number: 4,937,588

[45] Date of Patent: Jun. 26, 1990

[54] ARRAY OF COLLINEAR DIPOLES

[76] Inventor: Richard A. Austin, Powder House Rd., RD #1, Sandown, N.H. 03873

[21] Appl. No.: 896,439

[22] Filed: Aug. 14, 1986

[51] Int. Cl.[5] ..... H01Q 9/04

[52] U.S. Cl. ..... 343/791; 343/790; 343/792

[58] Field of Search ..... 343/791, 790, 792, 793, 343/801, 827

[56] References Cited

U.S. PATENT DOCUMENTS

| | | | |
|---|---|---|---|
| 1,683,739 | 9/1928 | Stone | 343/827 |
| 2,115,761 | 5/1938 | Blumlein | 343/790 |
| 2,158,376 | 5/1939 | Moser et al. | 343/791 |
| 2,486,597 | 11/1949 | Greene | 343/791 |
| 3,031,668 | 4/1962 | Bryson | 343/790 |
| 3,100,893 | 8/1963 | Brueckmann | 343/792 |
| 3,656,167 | 4/1972 | Lea | 343/793 |
| 4,087,823 | 5/1978 | Faigen et al. | 343/791 |
| 4,217,589 | 8/1980 | Stahler | 343/792 |

OTHER PUBLICATIONS

Moxon, "HF Antennas for all Locations", 1984, pp. 42–43.

*Primary Examiner*—Rolf Hille
*Assistant Examiner*—Hoanganh Le
*Attorney, Agent, or Firm*—Ross, Ross & Flavin

[57] ABSTRACT

A system for attaining an impedance match uses an array of collinear dipoles. By the shifting of the feedpoints away from the centers of the dipoles, the match may be made to any desired input feedpoint impedance.

5 Claims, 2 Drawing Sheets

ARRAY OF COLLINEAR DIPOLES

BACKGROUND OF THE INVENTION

1. Field of the Invention

My invention is directed to improvements in a high gain, vertically-polarized, omnidirectional antenna adaptable for use in the regions from the VHF to the microwave frequencies, with a configuration offering significantly improved current distribution in the collinearly arranged elements.

2. Description of the Prior Art

It is known that the impedance of a dipole fed at its center is approximately 70 ohms and further that as the feed point is shifted away from the center, the dipole impedance increases. It is the utilization of these phenomena that the impedance match of the antenna to any feedline impedance is achievable according to the letter and spirit of the present invention.

In two prior art patents, the Bryson patent, 3,031,668, and the Greene patent, 2,486,597, symmetrical series fed systems are disclosed, same requiring additional mechanisms for providing an impedance match between antenna and feedline.

Contrariwise, in the present invention the elements are fed in parallel.

SUMMARY OF THE INVENTION

The invention delineates an improved method of matching the antenna impedance with the feedline impedance, meaning any impedance feedline.

By way of exemplification, assume that four dipoles are fed in parallelism. The resulting impedance would be (70/4) or approximately 17.5 ohms.

In the case of the antennae about to be disclosed, the elements are fed in parallel. By offsetting the chokes in the correct relative positions of $1_1$ and $1_2$, the individual elements would have a feedpoint impedance of 200 ohms so as to result in an input feed impedance of the standard 50 ohms so common in the art today.

The method set forth is to be appreciated as useful in obtaining an impedance match to any desired input feed point impedance.

With the elements being fed in parallel, the current distribution on each of the elements is more uniform, leading to a superior radiation pattern with the peak of the major lobe positioned on the horizon as compared with a series fed configuration.

Also herein defined is an improved method for achieving beam tilting relative to an antenna axis.

By a proper configuration of the asymmetrical elements and by the interconnecting of the coaxial cable lengths, the current can be so affected in the individual elements as to cause a tilting of the major lobe, a feature having usefulness in applications where the surrounding terrain has a tendency to block antenna radiation as well as in applications where the operating frequency increases into the higher VHF and microwave regions, as for instance the region presently being used in the cellular phone systems.

And there is great interest today in a capability of directing antenna radiation downwardly so as to increase signal levels in user areas below the situs of the antenna.

Further, in summation, it is to be emphasized that, due to a spacing of one wavelength between elements, the same amount of gain is achievable with less than half the number of elements as compared with the series fed designs heretofore known. This reduces the number of interconnections between elements, same contributing to possibilities of added mechanical and/or electrical problems, a feature especially true as operating frequency might increase.

DESCRIPTION OF THE PREFERRED EMBODIMENTS

Figure 1:
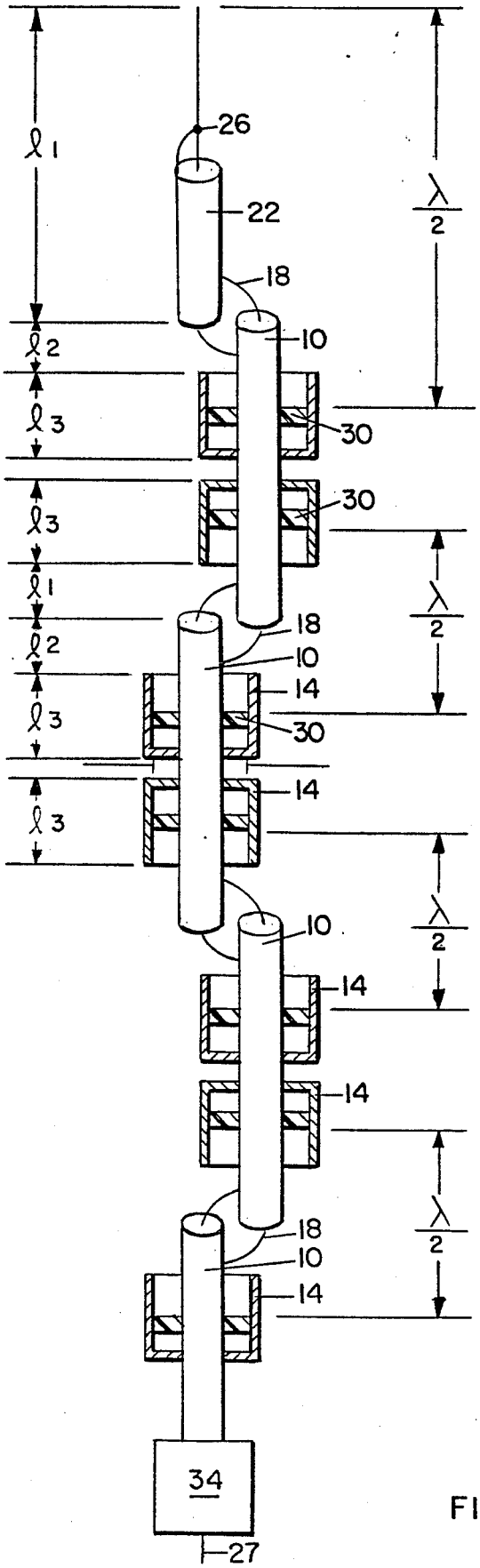
FIG. 1 is a schematic representation of the collinear dipole array embodying the invention.

I have shown a coaxial cable 20 having a velocity of propagation ($V_p$).

The electrical length of cable 10, say 14 inches, is equal to 3/2 wavelength at the operating frequency $f_o$. the length being determined by the formula:

$$36 \times \frac{492}{f_o} \times V_p = 14 \text{ (inches)}$$

the length being a critical factor in the design hereof for the pregnant reason that it determines the phase relationship of the currents flowing between the chokes 14 which are positionable asymmetrically relative to the feed points 18.

The preferred velocity of propagation is 0.7 inasmuch as this defines a spacing between feed points 18 of approximately 1 wavelength, i.e. $(3/2)\times 0.7 = 1.05$ As known, a spacing of 1 wavelength between collinear elements produces a maximum in antenna gain.

In this disclosure, the length of the coaxial cable which is electrically equal to ¼ wavelength at operating frequency $f_o$, is represented by $1_5$. Its length of 15 (inches) may be calculated via the formula:

$$2952/f_o \times V_p = 15 \text{ (inches)}$$

In the drawing, I have shown a coaxial cable 22 as being short circuited at the transmission feedline 26 in order to disclose a direct current path as a protection against lightning or any other unwanted electrical discharge.

Each choke 14 comprises a metallic cylinder having an inside diameter represented by d and is short circuited on one end of cable 10.

Diameter d is so selected that the ratio of the outside diameter of cable 10 to the inside diameter d of choke 14 defines an impedance which is equal to or preferably slightly higher than that of the transmission feedline 27.

The open end of each choke 14 faces toward a respective feed point 18.

The length $1_3$ of each choke is approximately ¼ wavelength at $f_o$.

Such a configuration provides a very high impedance to currents at operating frequency $f_o$ so as to allow a confinement of those currents to the areas between the open ends of the chokes.

Figure 2:
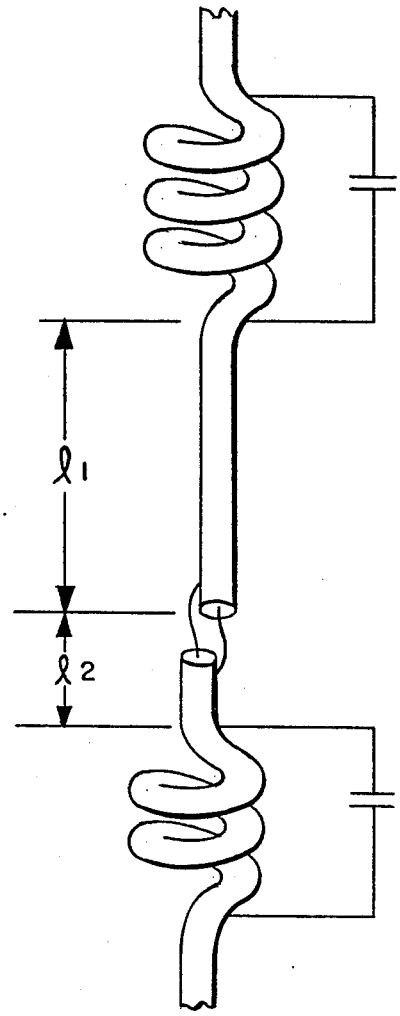
FIG. 2 is a schematic representation of the FIG. 1 chokes having a parallel inductor/capacitor equivalency.

In FIG. 2, I have schematically shown the chokes as serving as a parallel inductor/capacitor equivalent.

A dielectric material 30, which may be of solid or powder form, is insertable in each choke 14 for precisely tuning same to the operating frequency $f_o$.

A connector 34 serves for attaching the antenna to transmission feedline 27.

The antenna comprises a plurality of asymmetrical ½ wavelength elements equal to $1_1$ and $1_2$ formed on a sequential arrangement of cross-connected sections of cable 10, such sections or lengths being defined inwardly by feed points 18 and outwardly by the open ends of chokes 14.

Thus the parallel feeding of this configuration will be appreciated as contrasted with the series feeding systems earlier alluded to as being found in the prior art. As symmetrical series fed systems, these prior art devices dictate other mechanisms for providing an impedance match between antenna and feedline.

As known, the impedance of a dipole fed at its center approximates 70 ohms, and further that, as the feed point is shifted away from the center, the dipole impedance increases. This effect is exploited herein so as to achieve an impedance match of the antenna to any feedline impedance.

As illustrative, assume the feeding in parallel of four dipoles. The resulting impedance would be 70/4 or 17.5 ohms (approx.)

In the antenna of this invention where the elements are fed in parallelism, by offsetting the chokes to the correct position of $1_1$ and $1_2$, the individual elements would have a feedpoint impedance of 200 ohms, and the antenna's feedpoint is 50 ohms as is common in the art.

Thus, it is to be recognized that, by my method, it is possible to achieve an impedance match to any desired input feedpoint impedance.

Further, with the elements so fed in parallelism, the current distribution on each of the elements is more uniform leading to a superior radiation pattern with the peak of the major lobe being positioned on the horizon as compared to a series fed configuration.

By a proper configuration of the asymmetrical elements and the interconnecting cable lengths, the current can be affected in the individual elements so as to cause a tilting of the major lobe.

Another benefit is in offering a capability for directing antena radiation downwardly so as to increase the signal level in a user area below the antena location. This invention lends itself admirably to aiding in that purpose.

Because of the one wavelength spacing between the elements, the same amount of gain can sometimes be achieved with less than one-half the number of elements in contradistinction from series fed designs, all to the end that the number of interelement connections is dramatically reduced and mechanical and electrical problems are minimized accordingly. Such is especially true as the operating frequency increases.

I claim:

1. A parallel fed collinear element array of an antenna comprising: an energy source, a coaxial cable feedline connected to the source and consisting of a sequence of connected radiating sections having inner and outer conductors at the respective junctions of the sections, a series of asymmetrically positioned chokes each circumscribing a of the feedline and having an open end facing toward a respective feedpoint, the feedline being broken and cross connected at each connection of the radiating sections and related to the frequency of the source and the propagation velocity characteristics of the feedline for attaining a proper phase relationship with the energy radiated by each section the exterior of the feedline serving as the radiating surface, with the feedpoint impedance being reduced in proportion to the number of feedline sections.

2. In a parallel fed collinear element array, a source of radiated energy, a coaxial cable feedline comprising a connected sequence of radiating sections having inner and outer conductors at the respective junctions of the sections, the source energy being fed simultaneously to all sections from feedpoint to feedpoint and divided equally between the sections, the feedline being broken and cross connected at each junction between adjacent sections, the feedpoints being related to the frequency of the energy source and the propagation velocity characteristics of the feedline, a series of chokes each circumscribing a respective section of the feedline, the outside of the feedline defining a radiating source, the opening in the feedline at each cross connection allowing the radiated energy to flow on the outer surface of the feedline between the opposed open end of the respective asymmetrically positioned choke feedline becoming the, a dielectric in each choke being adjustable for forming a theoretical infinite impedance to the flow of energy beyond the open end of each choke.

3. In a parallel fed collinear element array, a coaxial cable feedline comprising a sequence of radiating sections having inner and outer conductors at the respective junctions of the sections, the feedline being broken and cross connected at each junction between adjacent sections, a series of a symmetrical positioned chokes each circumscribing a respective section of the feedline, a dielectric in each choke being adjustable for forming a theoretical infinite impedance to the flow of energy beyond the open end of the respective choke.

4. In an antenna, the combination of:

an array of collinear dipoles, a coaxial cable feedline in the form of a sequence of half wave radiating sections having inner and outer conductors cross-connected at the junctions of the sections, the feedline being broken and cross-connected at points related to the frequency and the propogation velocity characteristic of the feedline, a series of a symmetrically positioned quarter wave open ended chokes coaxially spaced along the feedline defining the outer ends of each respective radiating section, the open end of each choke facing a respective feedpoint.

5. A parallel fed collinear element array of an antenna comprising:

a coaxial cable feedline consisting of a sequence of interconnected radiating sections having inner and outer conductors at the respective section junctions, a asymmetrically positioned and choke circumscribing each section of the feedline, the feedline being broken and cross connected at the respective section junctions related to the frequency and the propagation velocity characteristics of the feedline for attaining a proper phase relationship with the energy radiated by each section, the paralleling of the radiating sections serving to reduce the feedpoint impedance proportionately according to the number of radiating sections, the feedline at each cross-connection allowing the energy being radiated to flow on the outer surface of the feedline as the radiating surface.

* * * * *